US005660594A

United States Patent [19]

Viljakainen

[11] Patent Number: 5,660,594

[45] Date of Patent: Aug. 26, 1997

[54] METHOD OF MAKING A THREADED CONNECTION FOR REINFORCING BARS

[75] Inventor: Kari Viljakainen, Mäkela, Finland

[73] Assignee: Tartuntamarkkinointi Oy, Villahde, Finland

[21] Appl. No.: 343,592

[22] PCT Filed: May 31, 1993

[86] PCT No.: PCT/FI93/00234

§ 371 Date: Feb. 22, 1995

§ 102(e) Date: Feb. 22, 1995

[87] PCT Pub. No.: WO93/24257

PCT Pub. Date: Dec. 9, 1993

[30] Foreign Application Priority Data

Jun. 1, 1992 [FI] Finland ..... 922525

[51] Int. Cl.[6] ..... B21K 1/56

[52] U.S. Cl. ..... 470/10

[58] Field of Search ..... 470/9, 10, 11, 470/12, 8, 17

[56] References Cited

U.S. PATENT DOCUMENTS

| | | | |
|---|---|---|---|
| 3,415,552 | 12/1968 | Howlett | 287/117 |
| 3,850,535 | 11/1974 | Howlett et al. | 403/304 |
| 4,500,224 | 2/1985 | Ewing | 403/343 |
| 4,594,020 | 6/1986 | Hughes | 403/343 |

FOREIGN PATENT DOCUMENTS

| | | |
|---|---|---|
| 0 059 680 A2 | 9/1982 | European Pat. Off. . |
| 0 171 965 A2 | 2/1986 | European Pat. Off. . |
| 0 327 770 A1 | 8/1989 | European Pat. Off. . |
| 0 448 488 A1 | 9/1991 | European Pat. Off. . |
| 2 227 802 | 8/1990 | United Kingdom . |

*Primary Examiner*—Lowell A. Larson
*Assistant Examiner*—Thomas C. Schoeffler
*Attorney, Agent, or Firm*—Kubovcik & Kubovcik

[57] ABSTRACT

A process for forming a screw thread on a corrugated bar used in concrete reinforcement joints such as anchor bolt joints. The ribs and flank fillets are removed from the end portion of the corrugated bar to be threaded. The end portion is then heated in a controlled manner such that the temperature of the end portion is highest at the end and falls smoothly toward the beginning of the ribless portion of the bar. The bar is immovably locked in place and the end portion is pressed by a movable cylindrical mold. Due to the temperature difference along the end portion, hot upsetting sets in at the end and advances toward the beginning of the ribless portion and the cross-sectional area of the end portion expands to become equal to an inner diameter of the mold. A screw thread is then formed on the end portion of the bar, the cross-sectional area of the screw thread being at least equal to the cross-sectional area of a remainder of the bar and the thread being longer than a diameter of the bar.

4 Claims, 1 Drawing Sheet

METHOD OF MAKING A THREADED CONNECTION FOR REINFORCING BARS

Figure 1A:
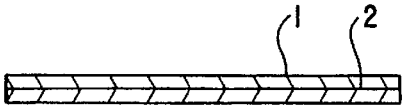

The present invention relates to a procedure for making a screw thread on a corrugated bar.

The corrugated bar used as raw material in the procedure of the invention for making a screw thread is produced from round section by a special forming method which produces the ribs of the corrugaged bar and simultaneously increases the strength of the steel during the manufacture. This manufacturing method increases the strength of the corrugated bar, and in addition the ribs produced become hardened, being of a considerably harder material.

Normal screw threads for a nut on a corrugated bar are made using known techniques either by rolling or by cutting. In these cases, the cross-section of the bar is reduced in the threaded portion and the tensile capacity of the bar is completely determined by the cross-section of the thread. The reduction in tensile capacity of the cross-section of the thread as compared to a solid bar is of the order of 20–30%. Thus, the tensile capacity of a threaded bar is exclusively determined by the cross-section of the thread, leaving the capacity of the rest of the bar unused, which means uneconomic use of steel. An economic target is to produce a thread whose tensional area is larger than or as large as the nominal area of the corrugated bar.

For the manufacture of a screw thread having the full tensile capacity of the corrugated bar, several methods have been patented. These are based on expanding the end of the corrugated bar by the cold upsetting method in room temperature. For example, patent application GB 2 227 802 presents a bar joint for use in the reinforcement of concrete, in which the cross-section of the bar ends to be joined is enlarged by cold upsetting and the ends are provided with a conical thread. FI-application 890509 presents a procedure for making mechanical joints between round reinforcement bars, in which the bars are joined together by means of a threaded sleeve placed at the juncture. According to this application, one or both ends of the bars to be joined are cold upset before threading. The upsetting is performed over the length of the part to be threaded and is so implemented that the root diameter of the threaded portion is at least equal to or larger than the normal diameter of the bars to be joined.

Cold upsetting causes no changes in the material or strength properties of corrugated bars. After the cold upsetting, the thread is produced on the upset area by cutting. This method preserves the strength properties of the steel bar unchanged, but it also removes material from the surface of the bar. By the cold upsetting method, the end of the corrugated bar can only be enlarged over a short length because the material structure of steel does not withstand cold upsetting well enough to allow a corrugated bar to be provided with a thread longer than that required for a nut. For joints requiring a long thread, the cold upsetting method is inadequate.

The object of the present invention is to eliminate the drawbacks of previously known techniques and to achieve a procedure for making a thread on a corrugated bar which preserves the increased strength of steel achieved during the manufacturing of the corrugated bar as well as the hardness of the steel surface and the toughness of the interior parts of the bar even during the threading process, allowing a thread with a full tensile capacity to be made on the corrugated bar.

In the procedure of the invention, the end of the corrugated bar is machined by removing the corrugation ribs and flank fillets of the bar. Next, the bar end is heated and then hot upset, thereby increasing its cross-sectional area. After the hot upsetting, the upset end of the corrugated bar is cooled. The bar end is threaded by rolling. The details of the features characteristic of the procedure of the invention are presented in the attached claims.

This procedure allows one to produce a thread with a tensional cross-section as large as or larger than the net cross-sectional area of a solid corrugated bar, which is decisive in respect of the bolt ratings. Moreover, regardless of the diameter of the corrugated bar, the threaded portion can be of a desired length depending on the use it is designed for. This means that all of the tensile capacity of the corrugated bar can be utilized, including the threaded portion, and the procedure makes it possible to produce a thread of any length as required. Thus, a threaded corrugated bar can be used in applications requiring a thread longer than that required by the nut length, in other words, the thread can be long enough to allow adjustment as required. Such applications include e.g. the anchor bolt joints of pillars.

In the following, the invention is described in detail by the aid of an example by referring to the attached drawing, in which FIG. 1*a* presents a corrugated bar and FIG. 1*b* a corrugated bar with a machined end.

Figure 2:
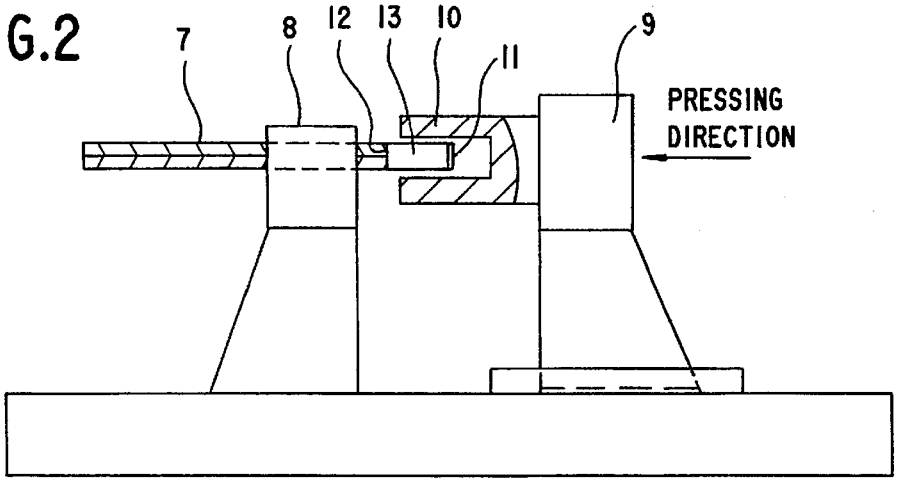

FIG. 2 illustrates the hot upsetting procdure.

Figure 3A:
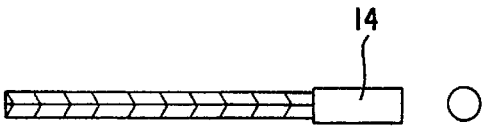
Figure 3B:
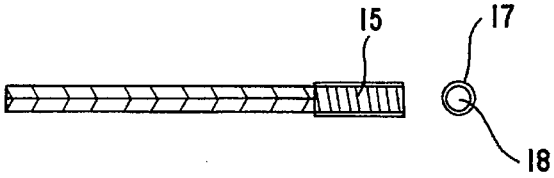

FIG. 3*a* presents a hot upset bar end and FIG. 3*b* a corrugated bar provided with a screw thread according to the invention.

Figure 1B:
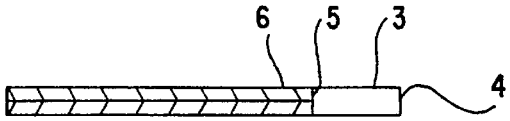

In the procedure for making a full-capacity screw thread, the end of the corrugated bar is first machined by turning it so as to remove the corrugation ribs 1 and the flank fillets 2 (FIG. 1*a*) from the bar area 3 to be threaded (FIG. 1*b*). In this way, the hardest parts of the corrugated bar are removed. In the manufacturing process of corrugated bars, the rib material undergoes the greatest changes. In the procedure of the invention, the parts of the hardest material, which constitute an impediment to hot upsetting as employed in the thread-making procedure, are removed from the corrugated bar.

The machined end 3 of the corrugated bar (FIG. 1*b*) is heated in a controlled manner so that a smooth temperature difference is created in the machined area 3 between the bar end 4 and the beginning 5 of the ribbed portion, the temperature being highest at the end 4 of the corrugated bar and falling smoothly towards the other end 5 of the machined portion. The temperature of the unmachined portion 6 of the corrugated bar is not raised except by heat transfer from the heated portion 5.

The heated corrugated bar 7 (FIG. 2) is locked in place by means of a hydraulic press 8 so that it cannot move. With another hydraulic press 9, a closed cylindrical mould 10 is pressed against the bar end 11 so that the end 11 of the corrugated bar begins to be hot upset and its cross-sectional area increases and becomes equal to the internal diameter of the cylindrical mold 10 in the press.

The end 7 of the corrugated bar is expanded so much that the cross-sectional area of the thread 15 to be formed will be at least equal to the cross-section of the rest of the bar 7, so that the tensile capacity of the bar is fully preserved even in the threaded portion.

The pressing force is applied from the end 11 of the bar towards the locking part 8 and is large enough to upset the bar and increase its cross-sectional area to the size of the mold. The purpose of the changing distribution of temperature in the machined portion of the bar is to ensure that the hot battering effect will start from the end 11 of the bar and, as the pressing force is increased, advance towards the other end 12 of the machined portion. With the smoothly changing temperature, the advance of the upsetting of the bar can be controlled all the time, and it also ensures that the upsetting will not start at the middle of the machined portion. Moreover, the temperature rising towards the end 11 of the bar ensures that the portion to be upset will not buckle before the upsetting effect sets in at the hottest point 11 . The molding is only stopped after the whole machined portion 13 has expanded and fills the mold 10.

After the hot upsetting, the upset end 14 of the bar (FIG. 3*a*) is cooled in a controlled manner so that the original strength characteristics of the corrugated bar can be preserved during the cooling process.

To make a full-capacity screw thread, the rolling method as known in prior art is used, whereby the cylindrical portion 14 formed on the bar via hot upsetting is worked with rollers to form a screw thread on the upset end of the bar without removing any material from it.

Through the rolling process, a thread is formed on the surface of the bar, and the rolling also has a strengthening effect on the material as the steel material 17 under rolling is cold formed, thereby increasing its strength and hardness. The cold strengthening effect of the rolling does not reach the interior part 18 of the bar, so the material inside the bar remains tough and the toughness characteristics of the whole threaded portion of the bar are preserved.

The rolling for the forming of the thread is only started after the end of the corrugated bar has been cooled to room temperature. The thread is made on the whole upset portion 14 of the corrugated bar. After this, no more turning is done on the bar.

By using the rolling method, the original hardness of the material in the threaded portion, which was lost during heating, is restored. In addition, the rolling also causes the bar material to be cold-strengthened in the threaded portion, enabling the original hardness of the surface of the corrugated bar to be restored in this part of the bar. The cold strengthening effect of the rolling does not reach the interior parts of the bar, so the good toughness properties of the corrugated bar can be preserved even in the threaded portion.

It is obvious to a person skilled in the art that different embodiments of the invention are not restricted to the example described above, but that they may instead be varied within the scope of the following claims.

I claim:

1. A process for forming a screw thread on a corrugated bar, said process comprising the steps of:

removing ribs and flank fillets from an end portion of a corrugated bar to be threaded, after removal said end portion extending from an end of said bar to a beginning of a ribless portion of said bar;

heating said end portion of said bar in a controlled manner by starting heating at said end such that the temperature of said end portion is highest at said end and falls smoothly toward said beginning of said ribless portion;

immovably locking said bar in place;

pressing said end portion of said bar by means of a movable cylindrical mold, the temperature difference between said end and said beginning of said ribless portion causing hot upsetting to set in at said end and advance toward said beginning of said ribless portion, whereby the cross-sectional area of said end portion of said bar expands to become equal to an inner diameter of said mold; and forming a screw thread on said end portion of said bar, the cross-sectional area of said screw thread being at least equal to the cross-sectional area of a remainder of said bar and said screw thread being longer than a diameter of said bar.

2. The process of claim 1, wherein the screw thread is formed by rolling.

3. The process of claim 2, wherein the corrugated bar is used in a concrete reinforcement joint.

4. The process of claim 2, wherein the corrugated bar is used in an anchor bolt joint.

* * * * *